US006553956B2

(12) United States Patent
Hora et al.

(10) Patent No.: US 6,553,956 B2
(45) Date of Patent: Apr. 29, 2003

(54) COMPOSITE LIGHTWEIGHT VALVE FOR INTERNAL COMBUSTION ENGINES

(75) Inventors: Pavel Hora, Kornwestheim (DE); Martin Schlegl, Kernen (DE); Karl-Heinz Thiemann, Korb (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/922,229

(22) Filed: Aug. 4, 2001

(65) Prior Publication Data

US 2002/0011228 A1 Jan. 31, 2002

(51) Int. Cl.[7] ..... F02N 3/00
(52) U.S. Cl. ..... 123/188.2; 29/888.45
(58) Field of Search ..... 123/188.2; 29/888.45, 29/888.4, 888.451

(56) References Cited

U.S. PATENT DOCUMENTS 1,255,469 A * 2/1918 Schlieder ..... 123/188.2
1,295,979 A * 3/1919 Gould et al. ..... 123/188.2
4,834,036 A * 5/1989 Nishiyama et al. ..... 123/188.2

FOREIGN PATENT DOCUMENTS

EP 0 296 619 12/1988

* cited by examiner

*Primary Examiner*—Noah P. Kamen
(74) *Attorney, Agent, or Firm*—Klaus T. Bach

(57) ABSTRACT

In a composite lightweight valve for internal combustion engines having a solid valve head provided with a center opening and a valve stem received in the center opening of the valve head in a positively locking manner, the valve components are permanently joined to one another by hot upsetting so as to be capable of withstanding the thermal and mechanical effective during engine operation.

8 Claims, 3 Drawing Sheets

COMPOSITE LIGHTWEIGHT VALVE FOR INTERNAL COMBUSTION ENGINES

BACKGROUND OF THE INVENTION

The invention relates to a method of manufacturing a composite lightweight valve for internal combustion engines having a valve stem and a valve head joined to the valve stem.

EP 0 296 619 A1 likewise shows a multi-part lightweight valve for internal combustion engines, which has a valve head and a valve stem. At the top, the valve head is provided with a blind bore for receiving the head-side end of the stem, which can be secured in the blind bore by shrink-fitting, cold pressing, soldering, by a mechanical joint or by a combination of such joining techniques. In an embodiment illustrated in the drawing of that document, the interior of the blind bore is of undulating design, the end-side wall of the stem tube being widened under the influence of pressure and local heating. In this way, the stem is intended to be engaged in a positively locking manner by the undulations in the bore.

A drawback of the lightweight valve which is known from EP 0 296 619 A1 is that the joint between valve stem and valve head is not sufficiently able to withstand the static and dynamic loads, which are considerable both with regard to thermal loads and with regard to mechanical loads. Temperature fluctuations from −20° C. to approximately 900° C. may arise, sometimes occurring within a short time, while the high temperature may, under certain circumstances, be effective for an extended period. Secondly, the joint is also simultaneously exposed to high dynamic and static loads in the tensile direction. This set of loads may lead to the joint between the valve stem and the valve head becoming loose after a relatively short operating time of the internal combustion engine, which could result in failure and complete destruction of the internal combustion engine.

Therefore, the object of the invention is to improve a composite lightweight valve in such a manner that it is capable of withstanding the thermal and mechanical loads occurring during engine operation.

SUMMARY OF THE INVENTION

In a method of manufacturing a composite lightweight valve for internal combustion engines having a solid valve head provided with a center opening and a valve stem with a shoulder received in the center opening of the valve head for engaging the valve head in a positively locking manner, the valve components are permanently joined to one another by hot upsetting so as to be capable of withstanding the thermal and mechanical effective during engine operation.

A significant advantage of the invention is that, as a result of the cooling after the upsetting operation, considerable pre-stresses, which act in the direction of the longitudinal axis of the valve, i.e. axially, are produced in the head-side end of the valve stem, and these pre-stresses provide for firm engagement of the valve head with the stem shoulder and a strong connection between the head and the valve stem. This connection is even stronger than a weld connection. This means that the fatigue strength is higher than that of a welded valve, for example. Because of the positive locking connection between the valve stem and the valve head in both axial directions, namely compression and tension, the joint is able to withstand the thermal and mechanical loads, which arise when the engine is operating without damage to the valve for an extended period of time. Moreover, this joining technique reduces manufacturing outlay to only a few tasks, specifically, to the outlay relating to the insertion operation (inserting the stem end into the center bore), to the upsetting operation and if appropriate, to a grinding operation (head-side stem end).

The inventive joining technique for the composite lightweight valve allows freedom of choice in terms of the materials used, in particular with regard to the valve head. It may, for example, be made from a material, which cannot be welded, or specifically, a material, which cannot be welded to the material of the valve stem.

Advantageous embodiments of the invention will be described below with reference to the accompanying drawings:

DESCRIPTION OF PREFERRED EMBODIMENTS

Figure 1A:
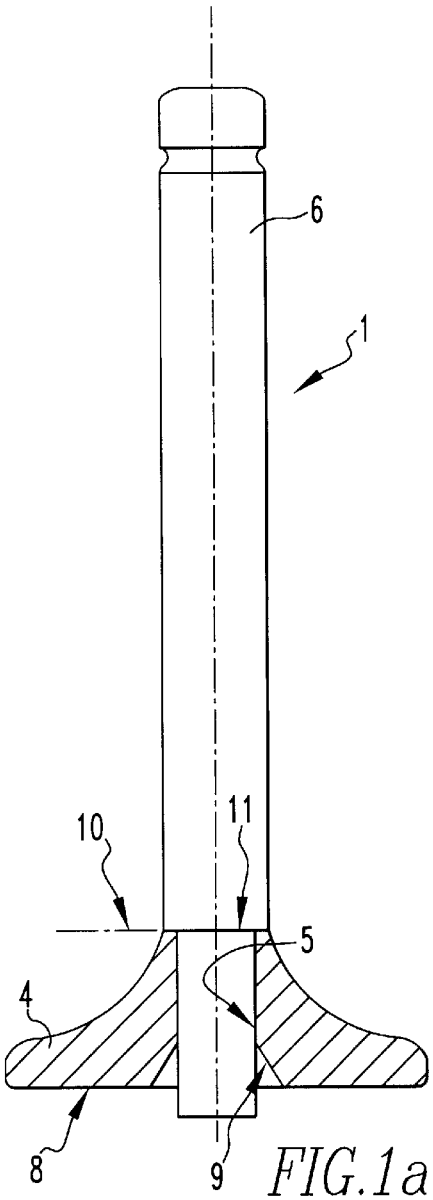
FIG. 1*a* is a sectional view through a first exemplary embodiment of a lightweight valve designed according to the invention, before the upsetting operation.
Figure 1B:
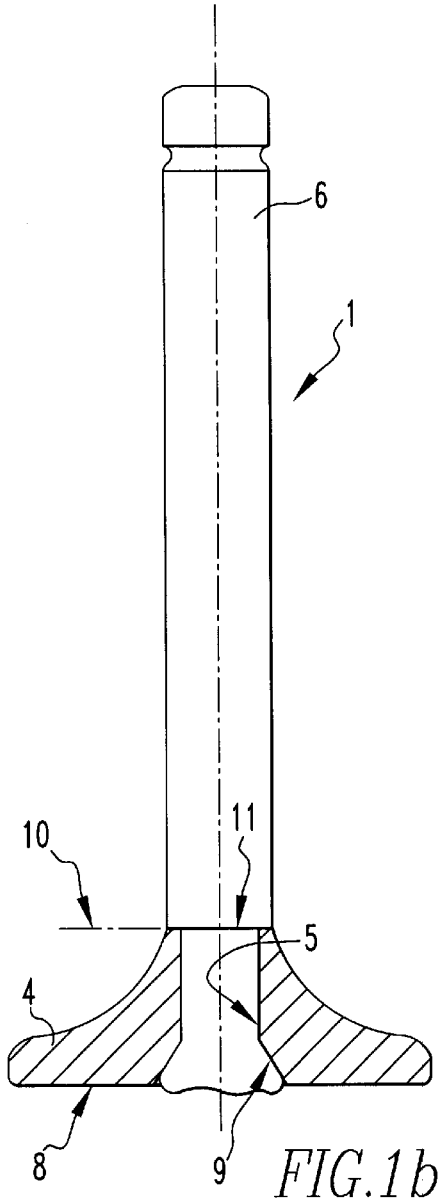
FIG. 1*b* shows the lightweight valve of FIG. 1*a* after the upsetting operation.
Figure 2A:
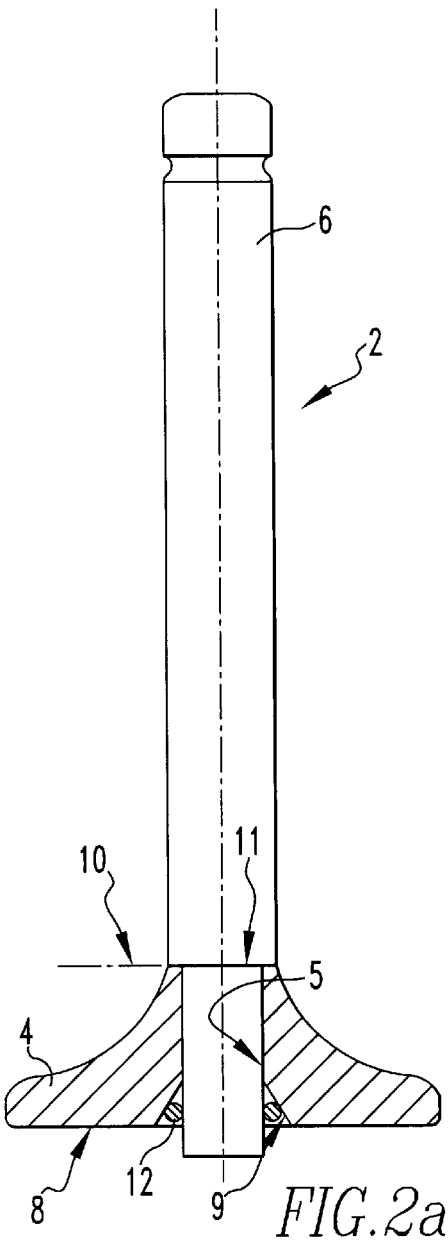
FIG. 2*a* is a sectional view through a second exemplary embodiment of a lightweight valve before the upsetting operation, with a ring of brazing solder inserted between valve head and valve stem.
Figure 2B:
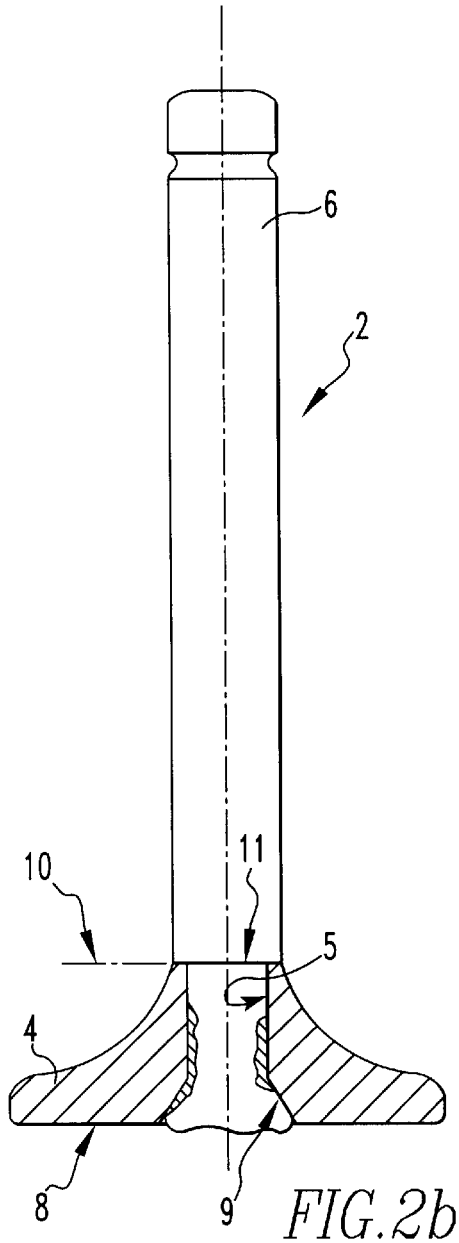
FIG. 2*b* shows the lightweight valve of FIG. 2*a* after the upsetting operation.
Figure 3A:
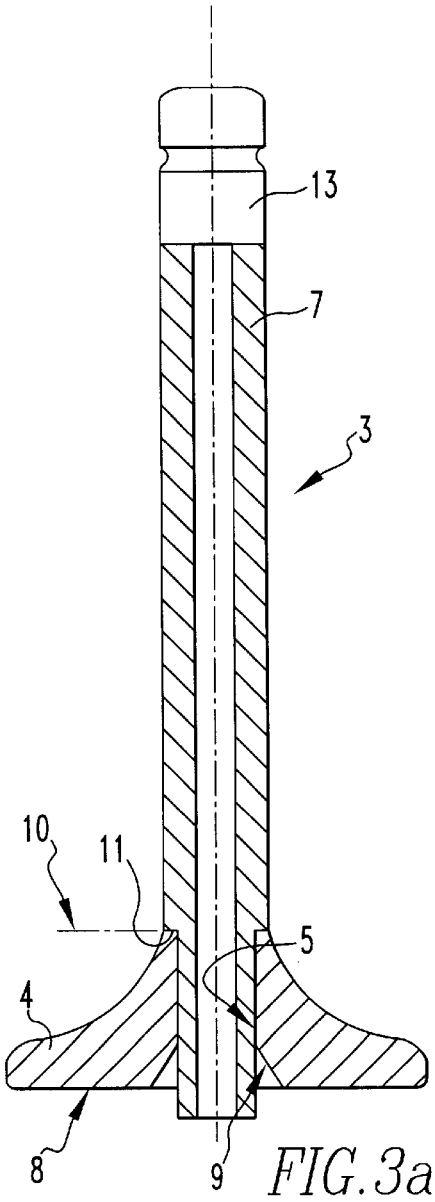
FIG. 3*a* is a sectional view through a third exemplary embodiment of a lightweight valve before the upsetting operation, the valve stem being of tubular design.
Figure 3B:
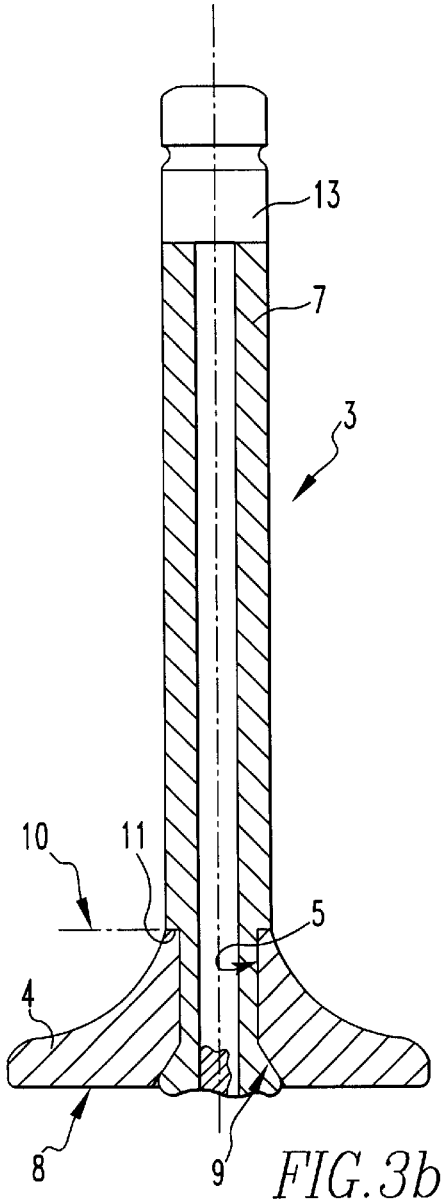
FIG. 3*b* shows the lightweight valve of FIG. 3*a* after the upsetting operation.

To start with, the common features of the various exemplary embodiments of lightweight valves 1 for internal combustion engines, which are illustrated in FIGS. 1*a*, 2*a* and 3*a*, will be dealt with briefly. FIGS. 1*b*, 2*b* and 3*b* illustrate the lightweight valves 1 to 3, after the upsetting operation has taken place. The lightweight valves 1 to 3 are all assembled from a number of parts and have a solid valve head 4 with a center opening 5 for receiving the head side end of the associated solid valve stem 6 (FIGS. 1 and 2) or the tubular valve stem 7 (FIG. 3) in a positively locking manner. The valve parts are permanently joined to one another, and the joining technique (hot upsetting/electro-upsetting) is common to all three valve variants.

The center opening 5 in the valve head 4, which is used to secure the valve stem 6, 7 and is as far as possible cylindrical, extends axially through the entire valve head 4. The center opening 5 in the valve head 4 is initially of cylindrical shape and widens toward the combustion-chamber-side flat side 8 of the valve head 4, in the form of a rotationally symmetrical delimiting contour 9, which, in the exemplary embodiments illustrated, is designed as a recess in the form of a cone. At the stem-side end, the center opening 5 is delimited by a rotationally symmetrical shoulder 10, which provides a surface perpendicular to the axis of the valve head 4 and against which the valve stem 6, 7 bears, in a pressure-transmitting manner by means of a collar 11.

The valve stem 6, 7 is fitted into the center opening 5, up to its collar 11, which limits the insertion depth and is perpendicular to the axis of the valve stem, bearing against the head-side shoulder 10 of the center opening 5.

The head-side end of the valve stem 6, 7, which has been inserted into the center opening 5, is disposed in the delimiting contour 9 at the combustion-chamber-side end of the center opening 5 in such a manner that it fills up this contour in a positively locking manner by means of electro-upsetting, which is explained in more detail below. In this way, the valve stem 6, 7 is secured in a positively locking manner so that it cannot be pulled out of the valve head 4 in the axial direction.

During the electro-upsetting, a voltage is applied to the valve stem 6, 7 with the result that the valve stem 6, 7 is heated to approx. 1000 to 1200° C. at the location of its smallest cross section, i.e. of the stem region, which has been inserted into the center opening 5. Then, the valve stem 6, 7 is upset under pressure, with the result that the head side end of the valve stem 6, 7, is pressed into the delimiting contour 9 in such a manner that it fills the latter up in a positively locking manner. After the upsetting operation has ended, the end of the valve stem 6, 7 is very hot, whereas the valve head 4 is relatively cool. The cooling of the stem after the electro-upsetting operation causes the end of the valve stem 6, 7 to contract thermally in the region of the inserted length, with the result that a very high axial pre-stress builds up in the valve stem 6, 7 over its entire inserted length within the center opening 5. This effect which is highly desirable with a view to secure engagement of the valve head 4 at the end of the stem 6, 7 despite different levels of heating and/or different thermal expansions of the joined parts. It causes the head 4 to be fixed more strongly than would be possible even by a welded joint.

Now that the common features of the various exemplary embodiments illustrated have been presented, the figures are explained individually below with regard to the remaining content of disclosure.

To provide additional securing in particular for exhaust valves, which are exposed to relatively high thermal loads, a ring 12 of brazing solder can be inserted into the center opening before the electro-upsetting. As shown in FIGS. 2*a* and 2*b*, the ring 12 substantially bears against the delimiting contour 9 of the center opening 5 and the solid valve stem 6. In the present case, the valve stem may also be of tubular design. Therefore, immediately during the electro-upsetting process, a soldered joint is formed between the valve head 4 and the valve stem 6, which additionally secures the valve stem 6 against radial twisting and axial movement out of the valve head 4 by material-to-material bonding. Prior to the joining operation, the valve head is preheated to up to 1000° C., so that the solder can flow optimally into the joint between head and stem. As an alternative, or in combination with the solder securing, it is possible to produce a positive lock between valve head 4 and valve stem 6, 7 by providing longitudinal grooves or other longitudinal profiles in the axial center opening 5 in the valve head 4, partly with a view to preventing rotation of the head 4 with respect to the stem 6 and 7.

As shown in FIGS. 3*a* and 3*b*, at its end opposite the valve head 4 the tubular stem 7 is closed off in a gas-tight manner by a valve stem end piece 13, and, at its head-side end, it is closed off in a gas tight manner by a fusion weld. It should also be noted that the cavity in the lightweight composite valve 3 may be filled with a cooling medium, preferably sodium, at least when the valve is an exhaust valve, which is exposed to relatively strong thermal loads. In this case, the coolant will expediently be introduced at the end of the stem, which is remote from the head, and the valve end piece 13 will be the final part added to the lightweight valve 3.

What is claimed is:

1. A method of manufacturing a lightweight valve for an internal combustion engine including a solid valve head with a flat end and a center opening enlarged at the flat end of said valve head, and a valve stem with a shoulder and an extension fitting through said opening, said method comprising the steps of heating at least the extension of said valve stem, inserting said extension into said opening so as to be seated with said shoulders thereof on said valve head, hot upsetting said extension so as to firmly engage the walls of said opening and filling said opening including the enlarged end thereof for positively locking said valve head to said valve stem and permitting cooling of said extension to thereby shorten said extension and firmly engage the valve head between the shoulder of said valve stem and the upset end thereof in said enlarged center opening area thereby pre-stressing said extension of said valve stem within said valve head.

2. A method according to claim 1, wherein said valve head is joined to the valve stem by electro-upsetting, the valve stem being heated by subjecting it to a voltage prior to the upsetting operation.

3. A method according to claim 1, wherein a ring of brazing solder is placed between the delimiting contour and the valve stem prior to the upsetting operation.

4. A method according to claim 1, wherein the valve head consists of ceramic or titanium aluminide (TiAl).

5. A method according to claim 1, wherein said valve stem consists of a highly heat-resistant steel.

6. A method according to claim 1, wherein said valve stem is of solid design.

7. A method according to claim 1, wherein said valve stem is of tubular design.

8. A method according to claim 1, wherein the enlargement of the center opening is conical in shape.

* * * * *